US009050983B2

(12) United States Patent
Tokumaru

(10) Patent No.: US 9,050,983 B2
(45) Date of Patent: Jun. 9, 2015

(54) ONBOARD APPARATUS AND TRAIN-POSITION CALCULATION METHOD

(75) Inventor: Makoto Tokumaru, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 247 days.

(21) Appl. No.: 13/611,975

(22) Filed: Sep. 12, 2012

(65) Prior Publication Data

US 2013/0116864 A1 May 9, 2013

(30) Foreign Application Priority Data

Nov. 7, 2011 (JP) ..... 2011-243397

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B61L 25/02*** | (2006.01) |
| ***B61L 15/00*** | (2006.01) |

(52) U.S. Cl.

CPC ..... *B61L 25/025* (2013.01); *B61L 25/02* (2013.01); *B61L 2205/04* (2013.01); *B61L 15/0027* (2013.01)

(58) Field of Classification Search

CPC ..... B61L 2205/04; B61L 25/02

USPC ..... 701/19

See application file for complete search history.

(56) References Cited

FOREIGN PATENT DOCUMENTS

| | | | | |
|---|---|---|---|---|
| JP | 2001-048021 | A | | 2/2001 |
| JP | 2001048021 | A | * | 2/2001 |
| JP | 2004-168216 | A | | 6/2004 |
| JP | 2008-137652 | A | | 6/2008 |
| JP | 2008137652 | A | * | 6/2008 |
| JP | 2008-247217 | A | | 10/2008 |
| JP | 2010-120484 | A | | 6/2010 |
| JP | 2010120484 | A | * | 6/2010 |

OTHER PUBLICATIONS

English Translation for JP 2008-137652.*
English Translation for JP 2010-120484.*
Office Action (Notice of Rejection) issued by the Japanese Patent Office on Dec. 3, 2013 in corresponding Japanese Patent Application No. 2011-243397 and an English translation of the Official Action. (4 pages).

* cited by examiner

* cited by examinerEnglish Translation for JP 2001-048021.*

*Primary Examiner* — Helal A Algahaim
*Assistant Examiner* — Mahmoud Ismail
(74) *Attorney, Agent, or Firm* — Buchanan Ingersoll & Rooney PC

(57) ABSTRACT

An onboard apparatus includes: a route database that stores start and end distances from a start point and a section length of the radiowave-reception difficult area; and an onboard control device that checks the rout database to determine whether the own train is in the radiowave-reception difficult area, and when the own train is not in the radiowave-reception difficult area, confirms whether position information has been obtained from a GPS receiver, and when the position information has not been obtained from the GPS receiver, executes control to stop the own train based on a running distance and a determination threshold for determining whether to stop the own train. When the own train is in the radiowave-reception difficult area, the onboard control device does not confirm whether the position information has been obtained from the GPS receiver, and updates a train position based on information from a speed power-generator.

11 Claims, 5 Drawing Sheets

ONBOARD APPARATUS AND TRAIN-POSITION CALCULATION METHOD

BACKGROUND OF THE INVENTION

1. Field of the Invention

The present invention relates to an onboard apparatus and a train-position calculation method for calculating a train position.

2. Description of the Related Art

There has conventionally been known an onboard-oriented train control device that subjectively manages a rail track position of a train and controls a train speed. The onboard-oriented train control device has GPS antennas and GPS receivers that are arranged in a distributed manner in a train constituted by a plurality of railway vehicles, and includes a storage device that stores therein route maps and GPS-antenna installation position information, so as to improve the reliability of detection of the train position. The onboard-oriented train control device performs positioning calculation by causing each GPS receiver to receive GPS signals from at least four satellites, and recognizes rail track position and direction of the entire train with using the route maps. Japanese Patent Application Laid-open No. 2004-168216 discloses such a technique.

However, according to the above conventional technique, because the train position is corrected in association with the route maps using the GPS signals at any time, when a train continues running in a non-received state of the GPS signals, a break is outputted to stop the train after running a specified distance, for the reason that the train position can not be surely located. Therefore, in a section where reception of the GPS signal is difficult because of the geographical reasons such as tunnels, valleys, places surrounded with buildings, even if any GPS signals can not be received momentarily during the section or near the section, a break may be outputted and the train may stop.

SUMMARY OF THE INVENTION

It is an object of the present invention to at least partially solve the problems in the conventional technology.

In order to solve the above-mentioned problems and achieve the object, one aspect of the present invention provides an onboard apparatus incorporated in a train, which updates a train position identified based on position information from a GPS receiver, by adding a running distance to the train position based on information from a speed power-generator that is obtained in a cycle shorter than a position-information acquisition cycle of the GPS receiver, the onboard apparatus comprising: a route database that stores a start distance and an end distance from a start point and a section length of a radiowave-reception difficult area where GPS signal reception is difficult in its own train running area; an onboard control device that checks the rout database to determine whether the own train is in the radiowave-reception difficult area, and when the own train is not in the radiowave-reception difficult area, confirms whether position information has been obtained from the GPS receiver, and when the position information has not been obtained from the GPS receiver, executes control to stop the own train based on the running distance and a determination threshold for determining whether to stop the own train, wherein as a result of determining whether the own train is in the radiowave-reception difficult area, when the own train is in the radiowave-reception difficult area, the onboard control device does not confirm whether position information has been obtained from the GPS receiver, and updates a train position based on information from the speed power-generator.

The other aspect of the present invention provides a train-position calculation method for an onboard apparatus incorporated in a train, which updates a train position identified based on position information from a GPS receiver, by adding a running distance to the train position based on information from a speed power-generator that is obtained in a cycle shorter than a position-information acquisition cycle of the GPS receiver, the train-position calculation method comprising: on the condition of the onboard apparatus including a route database that stores a start distance and an end distance from a start point, and a section length of a radiowave-reception difficult area where GPS signal reception is difficult in an area in which the train runs, an own-train-position determining step of checking the route database to determine whether the own train is in the radiowave-reception difficult area; a GPS-information confirming step of confirming whether position information has been obtained from the GPS receiver, based on a result of determining whether the own train is in the radiowave-reception difficult area, and determined that the own train is not in the radiowave-reception difficult area;

a train-stop controlling step of making control to stop the own train based on the running distance and a determination threshold for determining whether to stop the own train, when position information has not been obtained from the GPS receiver; and a train-position updating step of, without confirming whether position information has been acquired from the GPS receiver, updating the train position based on the information from the speed power-generator, based on a result of determining whether the own train is in the radiowave-reception difficult area, and determined that the own train is in the radiowave-reception difficult area.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an onboard apparatus according to the present invention will be explained below in detail with reference to the drawings. The present invention is not limited to the embodiments.

Figure 1:
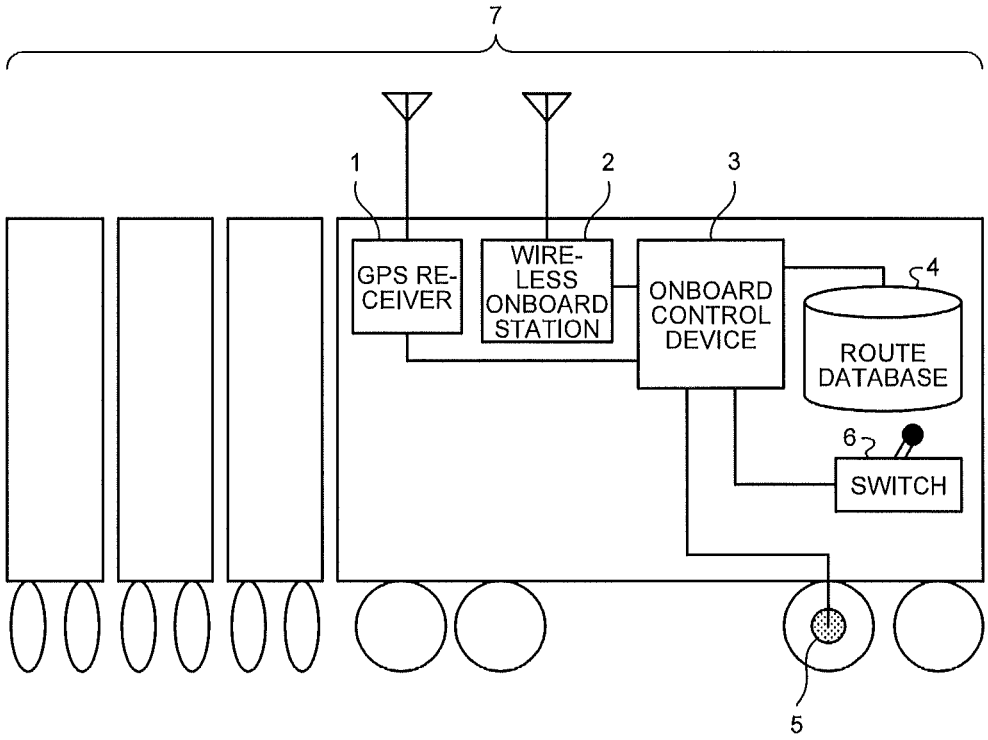
FIG. 1 is a diagram showing an example of a configuration of a train having an onboard apparatus incorporated therein.

FIG. 1 is a diagram showing an example of a configuration of a train having an onboard apparatus according to the present embodiment incorporated therein. The onboard apparatus is composed of a GPS receiver 1 that receives GPS signals, a wireless onboard station 2 that performs wireless communication with a ground side, a route database 4 that causes a kilometer distance on a railway where trains run to correspond to latitude and longitude information received from the GPS receiver 1, an onboard control device 3 that manages a train position and refers to the route database 4 and information from the wireless onboard station 2 to execute speed control, a speed power-generator 5 that generates pulses according to wheel rotation, a drive direction changing-over switch 6, and a train 7 in which these constituent elements are installed.

Figure 2:
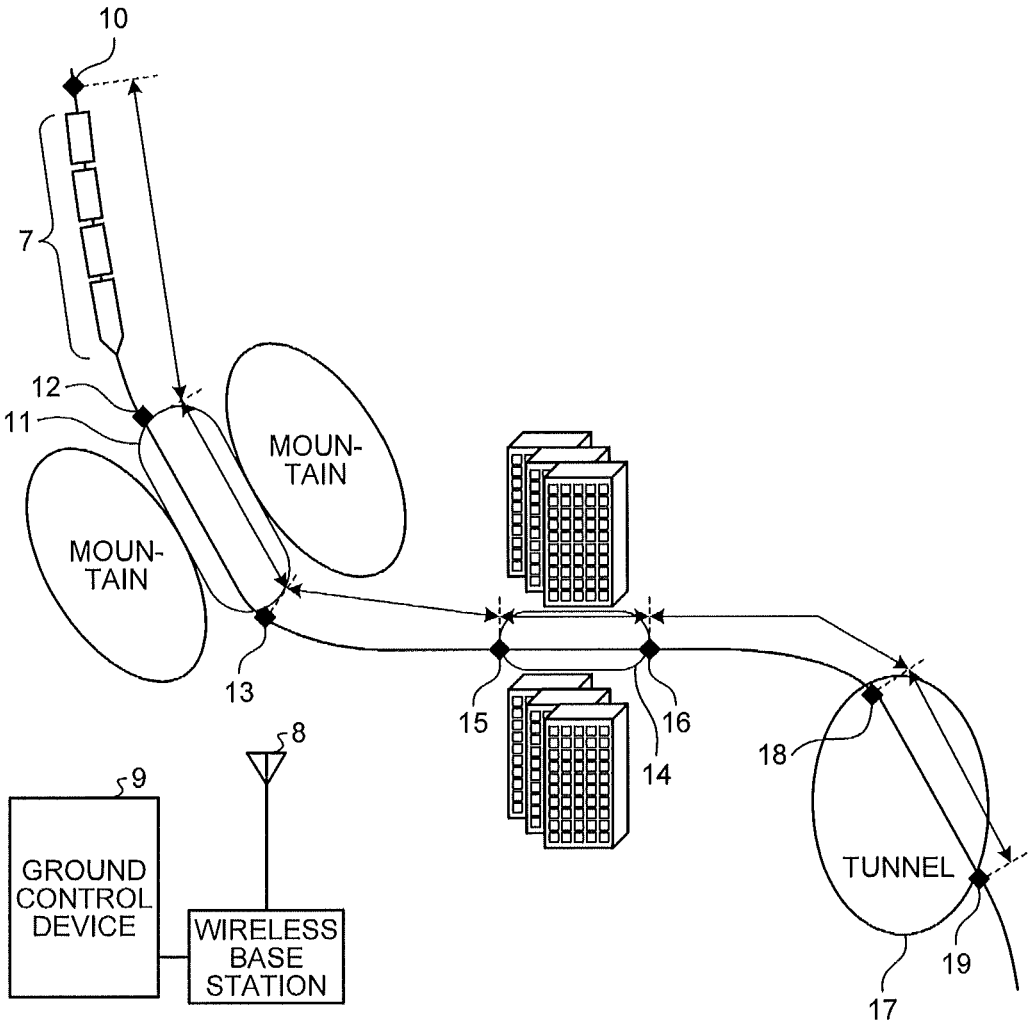
FIG. 2 is an illustration showing an area where a train runs.

An area where the train 7 runs is explained next. FIG. 2 is an illustration showing an area where the train 7 runs. This area includes, as apparatuses on the ground side, a wireless base station 8 that performs data transmission or reception to or from the wireless onboard station 2 of the train 7, and a ground control device 9 that manages current positions of a plurality of trains and transmits train interval control information generated based on the current position information and temporary speed limit information to the onboard control device 3 through the wireless base station 8 and the wireless onboard station 2.

In the area shown in FIG. 2, assuming that the start point of the control-target area of the ground control device 9 is a start point 10, there is a valley 11 where mountains cause GPS signals to be difficult to reach the train 7. The position (distance) from the start point 10 to the valley 11 can be specified by a start point 12 and an end point 13. Furthermore, there is a section where building shadows 14 cause GPS signals to be difficult to reach the train 7. The position (distance) from the start point 10 to the building shadows 14 can be specified by a start point 15 and an end point 16. In addition, there is a section where a tunnel 17 causes GPS signals to be difficult to reach the train 7. The position (distance) from the start point 10 to the tunnel 17 can be specified by a start point 18 and an end point 19.

Figure 3:
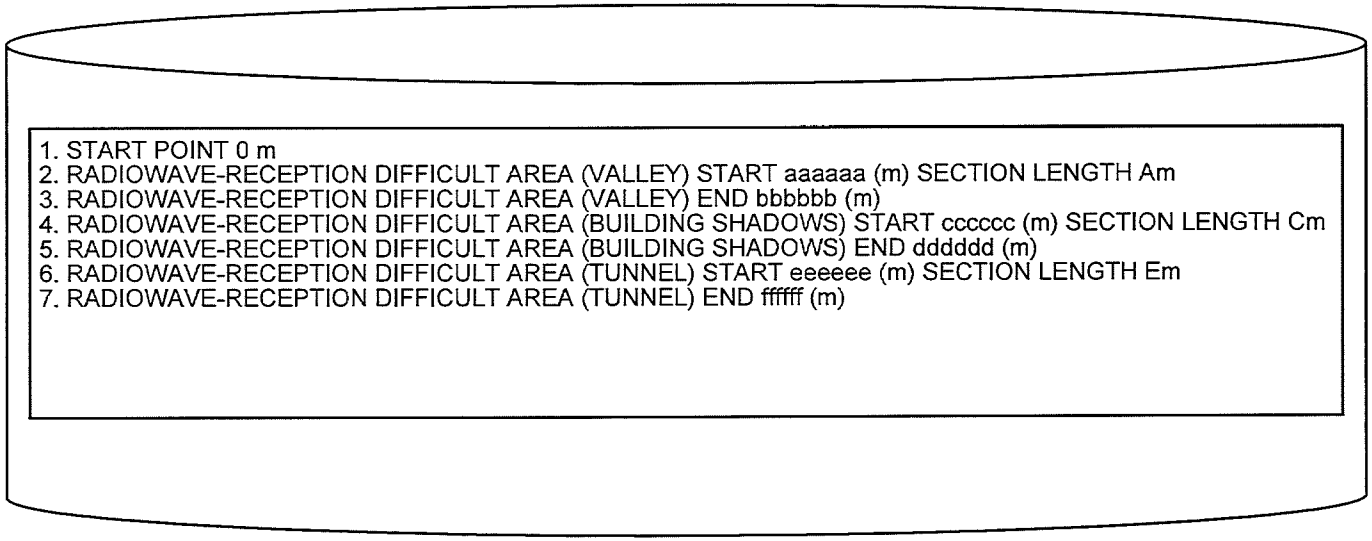
FIG. 3 is a sketch showing an example of a configuration of a table retained by a route database.

A table included in the route database 4 is explained next. FIG. 3 is a sketch showing an example of a configuration of the table included in the route database 4. The table specifies the sections shown in FIG. 2, where GPS signals are difficult to reach. More specifically, "1. start point 0 meter (m)" corresponds to the start point 10 in FIG. 2; "2. radiowave-reception difficult area (valley) start aaaaaa (m)" corresponds to the start point 12; "3. radiowave-reception difficult area (valley) end bbbbbb (m)" corresponds to the end point 13; "4. radiowave-reception difficult area (building shadows) start cccccc (m)" corresponds to the start point 15; "5. radiowave-reception difficult area (building shadows) end dddddd (m)" corresponds to the end point 16; "6. radiowave-reception difficult area (tunnel) start eeeeee (m)" corresponds to the start point 18; and "7. radiowave-reception difficult area (tunnel) end ffffff (m)" corresponds to the end point 19. The section length Am of the valley 11 can be calculated by "bbbbbb (m)-aaaaaa (m)". Similarly, the section length Cm of the building shadows 14 can be calculated by "dddddd (m)-cccccc (m)". The section length Em of the tunnel 17 can be calculated by "ffffff (m)-eeeeee (m)".

Operations fro identifying a position of the own train in the onboard apparatus and for the ground control device 9 to control train intervals are described next.

The onboard control device 3 updates position information by performing calculation processing with combining latitude and longitude information (in some cases, altitude information may be also used) obtained from the GPS receiver 1, a value converted to a kilometer distance from the start point 10 based on the route database 4, and a traveling kilometer distance obtained by sequentially calculating a traveling distance of the train 7 based on a pulse count obtained from the speed power-generator 5. The train 7 transmits the position information obtained in the above manner to the ground control device 9 through the wireless onboard station 2 and the wireless base station 8.

There is only one train 7 in the control area in FIG. 2. However, when there are a plurality of trains 7, the ground control device 9 obtains position information from the plurality of trains 7 in the similar manner and manages positions of the trains 7. The ground control device 9 transmits stop limit information, that is information for controlling a train interval, to the onboard control device 3 of each of the trains 7 through the wireless base station 8 and the wireless onboard station 2.

The onboard control device 3 performs sequential calculation processing based on the received stop limit information, the position of the own train, speed, and break performance of the own train, and executes control well in advance to stop the own train before the stop limit position on a side of the start point 10. To realize this control, the train 7 needs to detect and update the position of the own train with precision aimed for the control.

As compared to a position locating and correcting method using transponder sensors or the like arranged on the ground side to detect connection between the transponder sensors and onboard sensors provided onboard, the train-position calculation method using combination of the GPS receiver 1 and the speed power-generator 5 is suitable for the use of a long-distance route, as ground facilities are simplified. Meanwhile, in order to calculate train positions with high precision using the GPS receiver 1, it is necessary to receive GPS signals from four or more GPS satellites. Therefore, in the tunnel 17 where the train 7 can not receive any signals due to influence of the geographical feature in which the train 7 runs, or the valley 11 where only GPS signals from a GPS satellite directly above the train 7 can be received, or in the building shadows 14, train positions can not be located or corrected. The speed power-generator 5 can only calculate a difference between train positions, and so in order to locate a train position, latitude and longitude information from the GPS receiver 1 are necessary. Also for the difference between the train positions, because accumulated errors are aggregated due to an error in the wheel diameter, correction is necessary every time after the train runs for a certain distance, using the latitude and longitude information from the GPS receiver 1.

Figure 4:
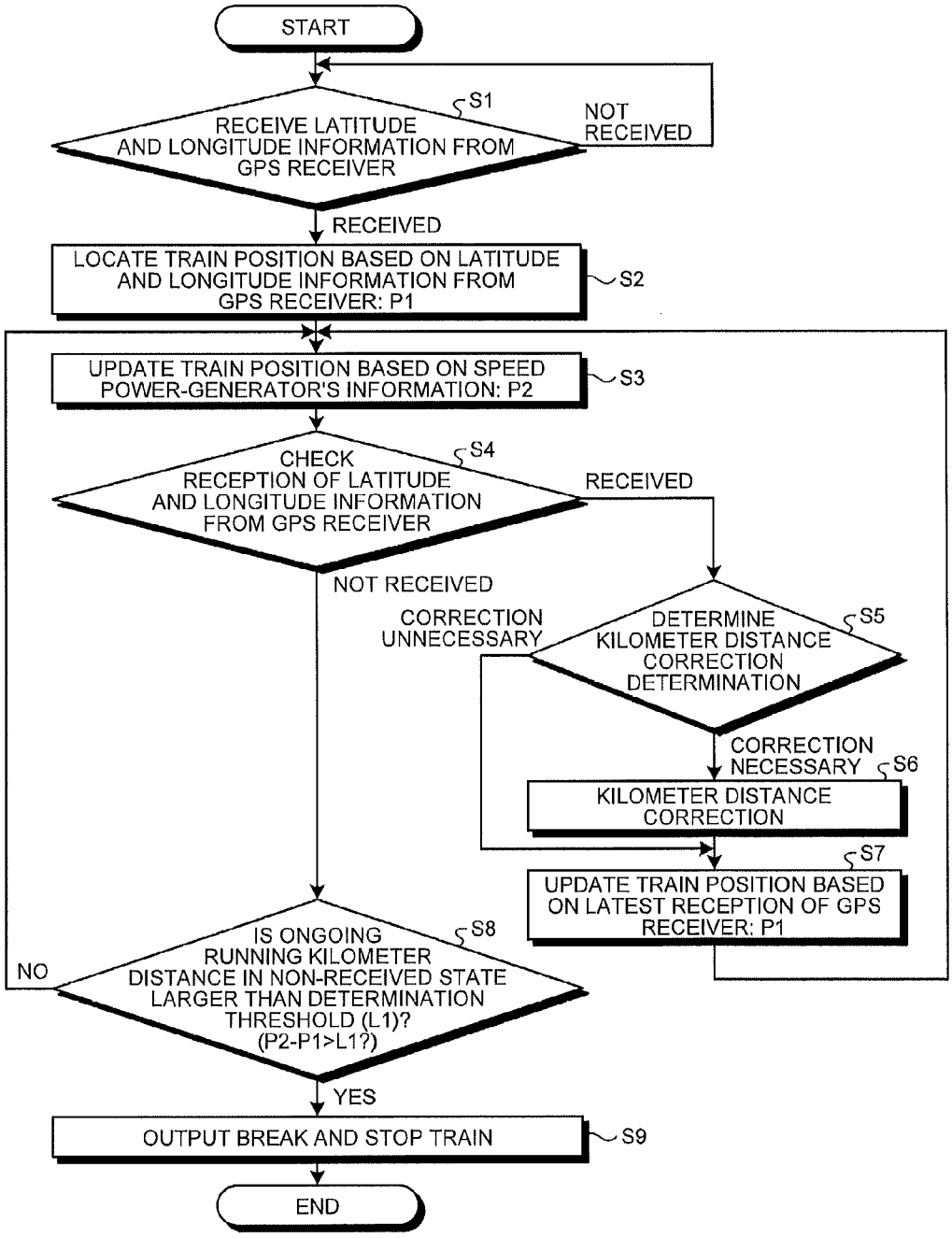
FIG. 4 is a flowchart showing a conventional train-position calculation method.

Now a conventional train-position calculation method is explained. FIG. 4 is a flowchart showing a conventional train-position calculation method. First, in the onboard apparatus, the onboard control device 3 waits until latitude and longitude information (position information) based on the GPS signals from the GPS receiver 1 is not received (Step S1: not received). The state where latitude and longitude information is not received from the GPS receiver 1 is a state where the GPS receiver 1 is not receiving the GPS signals. It is assumed that latitude and longitude information is transmitted from the GPS receiver 1 in cycles of about 1 second. When latitude and longitude information is received from the GPS receiver 1 (Step S1: received), the onboard control device 3 locates a train position P1 based on the latitude and longitude information from the GPS receiver 1 (Step S2).

Next, the onboard control device 3 updates the train position to P2 based on information from the speed power-generator 5 (Step S3). More specifically, a running distance from the time when the train position P1 has been located based on the latitude and longitude information from the GPS receiver 1 at Step S1, or from the time when the train position P2 has been updated based on the information from the speed power-generator 5 at the last time is added. Because the speed power-generator 5 transmits information in cycles of about 100 to 200 milliseconds that is shorter than the transmission cycle of the GPS receiver 1, the onboard control device 3 updates the train position P2 each time.

Next, the onboard control device 3 confirms whether the latitude and longitude information has been received from the GPS receiver 1 (Step S4). When the information is received (Step S4: received), whether kilometer distance correction is necessary is determined (Step S5). When correction is necessary (Step S5: correction necessary), the onboard control device 3 performs a process of correcting a kilometer distance (Step S6), and updates the train position P1 based on the information that has been received most recently from the GPS receiver 1 (Step S7). Then, returning to Step S3, the onboard control device 3 updates the train position to P2 based on information from the speed power-generator 5 (Step S3). On the other hand, when the correction is unnecessary (Step S5: correction unnecessary), the onboard control device 3 updates the train position P1 based on the information that has been received most recently from the GPS receiver 1, without correcting the kilometer distance (Step S7).

Returning to Step S4, when the latitude and longitude information has not been received from the GPS receiver 1 (Step S4: not received), the onboard control device 3 determines whether an ongoing running kilometer distance (that can be expressed by P2-P1), which is a train running distance in the non-received state, is larger than a determination threshold (L1) (Step S8). The determination threshold (L1) is a running distance for which compensation for an error of the own train's position can be achieved, in a case where the onboard control device 3 keeps updating the train position to P2 based on the information from the speed power-generator 5 in the non-received state of the information from the GPS receiver 1. The determination threshold (L1) is a value determined with regard to, for example, a stop limit based on a position of a train running before the own train, which has been acquired from the ground control device 9, in consideration of break performance or the like of the own train, and is a threshold for determining whether to stop the own train. The determination threshold (L1) can be set with a margin with respect to the stop limit. When it is equal to or smaller than the determination threshold (L1) (NO at Step S8), the onboard control device 3 returns to Step S3 and updates the train position to P2 based on the information from the speed power-generator 5 (Step S3). On the other hand, when it is larger than the determination threshold (L1) (YES at Step S8), the onboard control device 3 judges that the train position can not be surely located, and outputs a break to stop the train 7 (Step S9). After the train has stopped, a train driver or the like performs a recovery operation for correcting the position, and then resumes the processes from the start.

As described above, in the conventional train-position calculation method, after a train runs for a distance corresponding to the determination threshold (L1) with keeping in a non-received state of the GPS receiver 1, the onboard control device 3 executes control to stop the own train regardless of the state of the running area.

Figure 5:
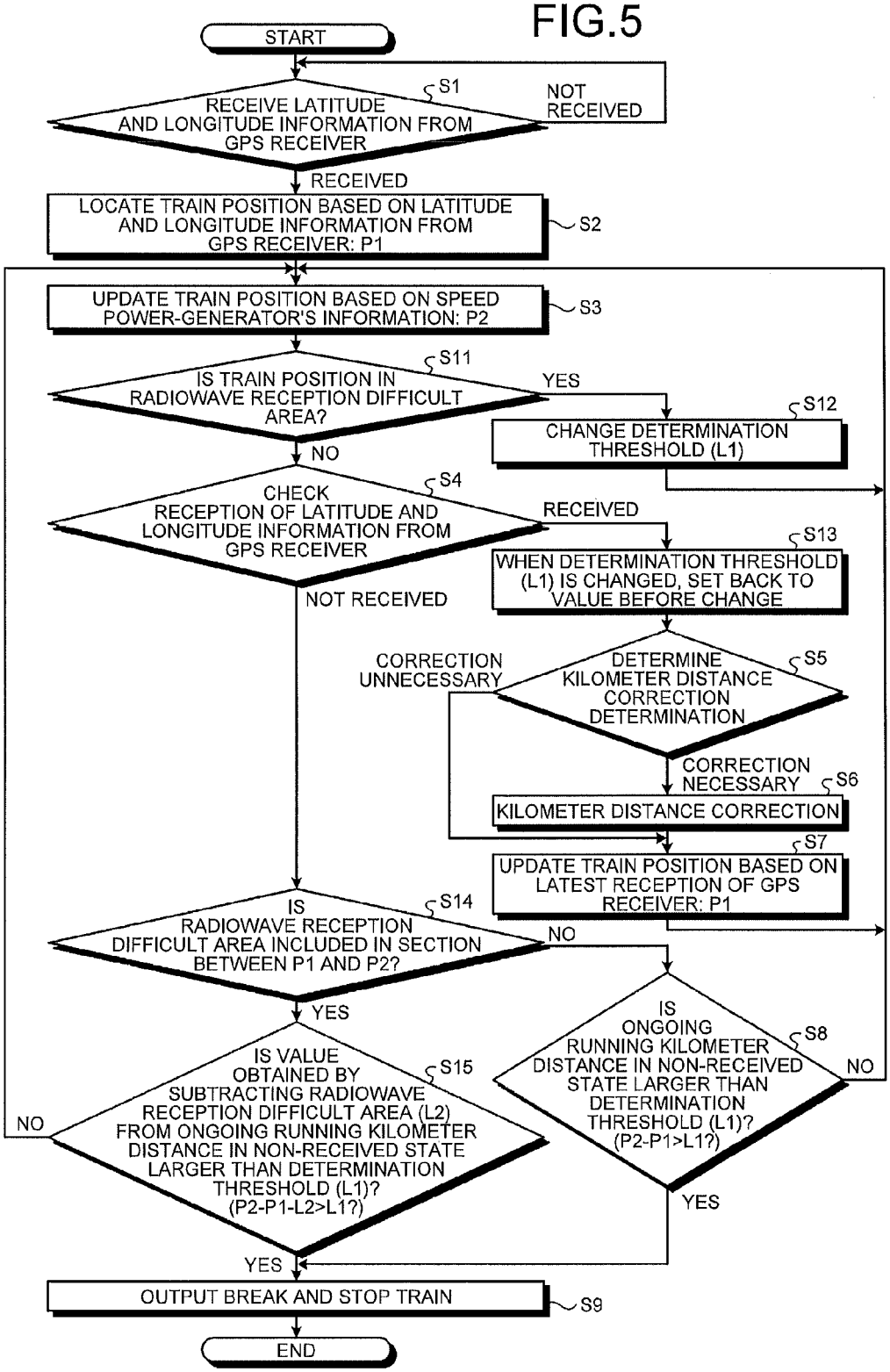
FIG. 5 is a flowchart showing a train-position calculation method according to the present embodiment.

A train-position calculation method according to the present embodiment is explained next. FIG. 5 is a flowchart showing a train-position calculation method according to the present embodiment. Steps S1 to S3 are identical to the conventional steps (see FIG. 4). After the onboard control device 3 updates the train position to P2 based on information from the speed power-generator 5 (Step S3), the onboard control device 3 confirms whether the position of the own train is a radiowave-reception difficult area (Step S11). By referring to the route database 4 shown in FIG. 3, the onboard control device 3 can confirm whether the current position of the own train is a radiowave-reception difficult area. When the own train is in the radiowave-reception difficult area (YES at Step S11), the onboard control device 3 changes the determination threshold (L1) in order to provide the stop limit with a margin (Step S12). Then, the onboard control device 3 returns to Step S3 without confirming whether latitude and longitude information has been acquired from the GPS receiver 1, and updates the train position to P2 based on the information from the speed power-generator 5 (Step S3).

When the own train is in the radiowave-reception difficult area, it is estimated that the GPS receiver 1 has not been able to receive signals from the GPS satellites, and so position precision of the own train may have become worse. Therefore, until latitude and longitude information is received again from the GPS receiver 1, a margin length is further added to the originally set margin to secure safety in order to provide a margin to the stop limit of the train. More specifically, addition of the margin length causes the determination threshold (L1) to become shorter. The margin length can be calculated by, for example, multiplying the section length of the radiowave-reception difficult area included in the route database 4 by a constant coefficient. As for a method of changing the determination threshold (L1), the determination threshold (L1) may be changed each time Step S12 is performed, or when Step S12 is performed plural number of times, the determination threshold (L1) may be changed only the first time and the changed determination threshold (L1) may be maintained thereafter. However, the method of changing the determination threshold (L1) is not limited thereto.

At Step S11, when the own train is not in the radiowave-reception difficult area (NO at Step S11), the onboard control device 3 confirms whether latitude and longitude information has been received from the GPS receiver 1 (Step S4). When the information has been received (Step S4: received), in the case where the determination threshold (L1) has been changed, the onboard control device 3 returns the determination threshold (L1) to the value before the change (Step S13). That is, the changed determination threshold (L1) is reset. It is then determined whether the kilometer distance correction is necessary (Step S5). Subsequent processes are identical to those of the conventional method (see FIG. 4). In a case where the determination threshold (L1) has not been changed, the onboard control device 3 does not perform any processes at Step S13, and determines whether the kilometer distance correction is necessary (Step S5).

Returning to Step S4, when the latitude information and longitude information has not been received from the GPS receiver 1 (Step S4: not received), the onboard control device 3 determines whether a radiowave-reception difficult area is included in the section between P1 and P2 (Step S14). Similarly to Step S11, the onboard control device 3 can determine whether a radiowave-reception difficult area is included in the section between P1 and P2 by referring to the route database 4 shown in FIG. 3. When it is not included (NO at Step S14), the onboard control device 3 determines whether an ongoing running kilometer distance in the non-received state is larger than the determination threshold (L1) (Step S8). Subsequent processes are identical to those of the conventional method (see FIG. 4).

On the other hand, when a radiowave-reception difficult area is included in the section between P1 and P2 (YES at Step S14), the onboard control device 3 determines whether a value, which is obtained by subtracting a value of the radiowave-reception difficult area (designated as L2) from the ongoing running kilometer distance in the non-received state from the GPS receiver 1, is larger than the determination threshold (L1) (Step S15). More specifically, the radiowave-reception difficult area (L2) corresponds to a section length stored in the route database 4. When the value is equal to or smaller than the determination threshold (L1) (NO at Step S15), the onboard control device 3 returns to Step S3 and updates the train position to P2 based on the information from the speed power-generator 5 (Step S3). On the other hand, when the value is larger than the determination threshold (L1) (YES at Step S15), the onboard control device 3 estimates that the train position can not be surely located, and outputs a break to stop the train 7 (Step S9).

As described above, in the onboard apparatus incorporated in the train 7, in which a train position identified based on information from the GPS receiver is updated by adding a running distance based on information from the speed power-generator, which is obtained in a cycle shorter than an information acquisition cycle of the GPS receiver, stopping of the train 7 due to a break output is avoided when the train is running in a radiowave-reception difficult area. Also in a section other than the radiowave-reception difficult area, when a radiowave-reception difficult area is included in the section where the train runs with no reception of radiowave from the GPS receiver 1, a value of the radiowave-reception difficult area is subtracted from the distance, and a comparison with the determination threshold (L1) is performed. At this time, the determination threshold (L1) is changed for securing safety. Accordingly, stopping of the train 7 immediately after passing the radiowave-reception difficult area is avoided.

It has been explained that, when the train is in a radiowave-reception difficult area, the onboard control device 3 changes the determination threshold (L1) for providing a margin to the stop limit, but this is not limitation. For example, by providing a margin to the determination threshold (L1) in advance, it is possible not to change the determination threshold (L1) even when the train is in the radiowave-reception difficult area. In this case, processes of Steps S12 and S13 can be omitted.

As explained above, the present embodiment is directed to the case where the onboard apparatus retains information regarding a radiowave-reception difficult area in which GPS signal reception is difficult because of the geographic reasons, and when it is not possible to receive GPS signals in the own train, the radiowave-reception difficult area is not targeted for the running kilometer distance required to stop the train. With this configuration, even if a state where latitude and longitude information can not be received from the GPS receiver 1 continues for a certain period of time, it is possible to avoid a situation that a break output causes the train to stop during its running in the radiowave-reception difficult area or immediately after its passing through the radiowave-reception difficult area, while controlling trains to be at safe train intervals.

The present invention has been achieved in view of the above circumstances, and an object of the present invention is to provide an onboard apparatus that can avoid stopping of a train when the train passes a section where GPS signal reception is difficult or immediately after the train has passed the section.

The present invention has advantageous effects that it is possible to avoid a situation in which a train is easily stopped in a section where GPS signal reception is difficult or immediately after the train has passed the section.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An onboard apparatus incorporated in a train, which updates a train position identified based on position information from a GPS receiver, by adding a running distance to the train position based on information from a speed power-generator that is obtained in a cycle shorter than a position-information acquisition cycle of the GPS receiver, the onboard apparatus comprising:

a route database that stores a start distance and an end distance from a start point and a section length of a radiowave-reception difficult area where GPS signal reception is difficult in a running area of the train;

an onboard control device configured to check the route database to determine whether the train is in the radiowave-reception difficult area, and when the train is not in the radiowave-reception difficult area, confirm whether position information has been obtained from the GPS receiver, and when the position information has not been obtained from the GPS receiver, execute control to stop the train based on the running distance and a determination threshold for determining whether to stop the train, wherein when position information has not been obtained from the GPS receiver, in a case where a section of the running distance does not include the radiowave-reception difficult area, the onboard control device is configured to compare the running distance with the determination threshold, and execute control to stop the train when the determination threshold is smaller than the running distance, and in a case where the section of the running distance includes the radiowave-reception difficult area, the onboard control device is configured to compare a value obtained by subtracting a section length of the radiowave-reception difficult area, which is stored in the route database, from the running distance with the determination threshold, and execute control to stop the train when the determination threshold is smaller than the value.

2. The onboard apparatus according to claim 1, wherein as a result of determining whether the train is in a radiowave-reception difficult area, when the train is in the radiowave-reception difficult area, the onboard control device is configured to set a value of the determination threshold to a changed state, and as a result of confirming whether the position information has been obtained from the GPS receiver, when position information has been obtained from the GPS receiver, if the value of the determination threshold has been changed, then the onboard control device is configured to set the value of the determination threshold back to a value before the change.

3. The onboard apparatus according to claim 2, wherein each time the onboard control device determines that the train is in a radiowave-reception difficult area, the onboard control device is configured to subtract a value based on the section length from the determination threshold.

4. The onboard apparatus according to claim 2, wherein when the train is in a radiowave-reception difficult area, when the determination threshold has not been changed, the onboard control device is configured to subtract a value based on the section length from the determination threshold.

5. A train-position calculation method for an onboard apparatus incorporated in a train, which updates a train position identified based on position information from a GPS receiver, by adding a running distance to the train position based on information from a speed power-generator that is obtained in a cycle shorter than a position-information acquisition cycle of the GPS receiver, the train-position calculation method comprising:

checking a route database that stores a start distance and an end distance from a start point, and a section length of a radiowave-reception difficult area where GPS signal reception is difficult in an area in which the train runs, and determining whether the train is in the radiowave-reception difficult area;

confirming whether position information has been obtained from the GPS receiver, based on a result of determining whether the train is in the radiowave-reception difficult area, when determined that the train is not in the radiowave-reception difficult area; and controlling the train to stop based on the running distance and a determination threshold for determining whether to stop the train, when position information has not been obtained from the GPS receiver, wherein the train-stop controlling comprises:

in a case where a section of the running distance does not include the radiowave-reception difficult area, comparing the running distance with the determination threshold, and executing control to stop the train when the determination threshold is smaller than the running distance; and in a case where the section of the running distance includes the radiowave-reception difficult area, obtaining a value by subtracting a section length of the radiowave-reception difficult area, which is stored in the route database, from the running distance and comparing the value with the determination threshold, and controlling the train to stop when the determination threshold is smaller than the value.

6. The train-position calculation method according to claim 5, further comprising:

as a result of determining whether the train is in a radiowave-reception difficult area in the train-position determining when the train is determined to be in the radiowave-reception difficult area, setting a value of the determination threshold to a changed state; and as a result of confirming whether the position information has been obtained from the GPS receiver in the GPS-information confirming when position information is confirmed to be already acquired from the GPS receiver, setting the value of the determination threshold back to a value before the change when the value of the determination threshold has been changed.

7. The train-position calculation method according to claim 6, wherein in the determination-threshold changing, each time it is determined that the train is in a radiowave-reception difficult area, a value based on the section length is subtracted from the determination threshold.

8. The train-position calculation method according to claim 6, wherein in the determination-threshold changing, in the case where the train is in a radiowave-reception difficult area, when the determination threshold has not been changed, a value based on the section length is subtracted from the determination threshold.

9. The onboard apparatus according to claim 1, wherein as a result of determining whether the train is in a radiowave-reception difficult area, when the train is in the radiowave-reception difficult area, the onboard control device is configured to set a value of the determination threshold to a changed state, and as a result of confirming whether the position information has been obtained from the GPS receiver, when position information has been obtained from the GPS receiver, if the value of the determination threshold has been changed, then the onboard control device is configured to set the value of the determination threshold back to a value before the change.

10. The onboard apparatus according to claim 9, wherein each time the onboard control device determines that the train is in a radiowave-reception difficult area, the onboard control device is configured to subtract a value based on the section length from the determination threshold.

11. The onboard apparatus according to claim 9, wherein when the train is in a radiowave-reception difficult area, when the determination threshold has not been changed, the onboard control device is configured to subtract a value based on the section length from the determination threshold.

* * * * *